US006727863B2

(12) United States Patent
Wen et al.

(10) Patent No.: US 6,727,863 B2
(45) Date of Patent: Apr. 27, 2004

(54) PLANAR BAND GAP MATERIALS

(75) Inventors: Weijia Wen, Kowloon (HK); Ping Sheng, Kowloon (HK); Che Ting Chan, New Territories (HK); Weikun Ge, New Territories (HK); Lei Zhou, Kowloon (HK); Jensen Li, Chai Wan (HK)

(73) Assignee: The Hong Kong University of Science and Technology, Kowloon (HK)

( * ) Notice: Subject to any disclaimer, the term of this patent is extended or adjusted under 35 U.S.C. 154(b) by 32 days.

(21) Appl. No.: 09/983,852

(22) Filed: Oct. 26, 2001

(65) Prior Publication Data

US 2003/0080921 A1 May 1, 2003

(51) Int. Cl.[7] ..... H01Q 15/02; H01Q 15/24

(52) U.S. Cl. ..... 343/909; 343/700 MS; 343/756

(58) Field of Search ..... 343/700 MS, 702, 343/909, 873, 756; H01Q 15/02, 15/24

(56) References Cited

U.S. PATENT DOCUMENTS

| | | | | | |
|---|---|---|---|---|---|
| 5,309,001 | A | * | 5/1994 | Watanabe et al. | 257/99 |
| 6,104,349 | A | | 8/2000 | Cohen | |
| 6,127,977 | A | | 10/2000 | Cohen | |
| 6,140,975 | A | | 10/2000 | Cohen | |
| 6,452,553 | B1 | | 9/2002 | Cohen | |
| 2002/0149519 | A1 | | 10/2002 | Varadan et al. | |
| 2002/0195598 | A1 | * | 12/2002 | Ugajin | 257/15 |
| 2003/0142036 | A1 | * | 7/2003 | Wilhelm et al. | 343/909 |

* cited by examiner

*Primary Examiner*—Hoanganh Le
(74) *Attorney, Agent, or Firm*—Burns, Doane, Swecker & Mathis, L.L.P.

(57) ABSTRACT

The present invention relates to planar materials having bandgap properties. The materials are formed by depositing conductive fractal patterns on a non-conducting substrate. The bandgap location(s) are defined by parameters including the number of fractal levels, and the dimension of the fractal mother element. The bandgaps can also be actively controlled by injecting current into the conducting pattern.

13 Claims, 13 Drawing Sheets

PLANAR BAND GAP MATERIALS

FIELD OF THE INVENTION

This invention relates to novel planar materials having band gap properties, and in particular to such materials formed with fractal patterns.

BACKGROUND OF THE INVENTION

Band gap materials are materials that have a gap in the transmission band through which electromagnetic radiation will not be transmitted. Such materials are conventionally constructed as three-dimensional crystal structures known as photonic crystals designed to give a desired photonic band gap. Such photonic band gap materials have a large number of potential applications. However, conventional photonic band gap materials must be fabricated as a composite material with a modulation of the dielectric properties. Because the band gap is caused by Bragg scattering within the crystal, this modulation must be of the same order of the wavelength of the band gap. For example, for optical photonic crystals there must be microstructures of the order of 0.1 microns, which makes them extremely difficult and costly to fabricate. On the other hand photonic crystals designed to work in the radio or microwave spectrum would have sizes in the range of a few centimeters or more, which would often make them too large and bulky for practical applications. For example, a photonic crystal with a band gap centered around 0.9 GHZ would make a perfect shield for mobile phones (for example for isolating a user from any potentially harmful radiation), except that the photonic crystal would have to be larger than the phone itself. For reasons such as these, photonic materials have yet to be used on a widespread basis.

PRIOR ART

Fractal patterns have been known for a number of years in mathematics. They have proved to be a useful tool in the analysis of mathematically complex and chaotic situations. They have yet, however, to find widespread practical applications in the physical sciences. A number of recent patents, however, attempt to find applications for fractal patterns in the field. For example, U.S. Pat. No. 6,127,977 (Cohen) describes a microstrip patch antenna formed with a fractal structure on at least one surface of a substrate. U.S. Pat. No. 6,140,975 (Cohen) describes an antenna structure with a fractal ground counterpoise and a fractal antenna structure. U.S. Pat. No. 6,104,349 discusses tuning fractal antennas and fractal resonators.

SUMMARY OF THE INVENTION

According to the present invention there is provided a planar bandgap material comprising a conductive fractal pattern formed on a non-conducting planar substrate.

The fractal pattern may be formed with any number of levels, but between 2 and 15 levels may be sufficient. The low-frequency limit of the bandgap(s) possessed by the material is determined by the number of levels of said fractal pattern, as well as the size and the geometry of the fractal pattern in each level In preferred embodiments the fractal pattern is formed by subjecting a mother element to a repeated affine transformation. This mother element may be an H-shape and said transformation comprises scaling and rotation. However, it should be noted that the mother element does not have to be an H-shape and other possible shapes may be employed. Preferably, however, the mother element is a shape such that when it is subject to an affine transformation by scaling and rotating repeatedly to form the fractal pattern, the resultant pattern is "self-avoiding" so that the conductive elements do not run into each other or overlap. Other possible shapes for the mother element include a Y-shape, a V-shape and the shape of a tuning fork.

Preferably the fractal pattern is embedded within a dielectric material.

More prferably still there may be provided means for injecting a current into the fractal pattern so as to alter the bandgap properties of said material.

Viewed from another aspect the present invention provides a planar bandgap material comprising a conductive fractal pattern formed on a non-conducting planar substrate and having at least one bandgap wherein all the dimensions of the material are smaller than the wavelength at said bandgap.

Viewed from a still further aspect the invention provides an electromagnetic radiation shield comprising a conductive fractal pattern formed on a substrate.

The present invention also extends to a method of forming a bandgap material comprising depositing a conductive fractal pattern on a planar substrate, and wherein the locations of the bandgaps are controlled by selecting the dimensions of a mother element of said pattern and the number of levels of said pattern.

The method may further comprise embedding said fractal pattern in a dielectric substrate.

The method of forming a bandgap material may further comprise providing means for injecting a current into said pattern whereby the bandgap properties of said material may be altered.

Viewed from a further aspect the present invention provides a narrow-band electromagnetic filter comprising a wire mesh material adjacent to a plate formed with a conducting fractal pattern thereon.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

In a first embodiment of the invention, a photonic band gap material is formed by a conductive fractal pattern on a substrate. The material can be made by any conventional method of forming a conductive pattern on a substrate. Simply as an example, for microwave applications the pattern can be formed by a variety of techniques including shadow-masking/etching, standard printed circuit board techniques, or simply by printing a computer-generated pattern with conductive ink (eg silver ink). For infra-read applications, a metal fractal pattern (eg Ni or Al) can be deposited on glass by thermal evaporation or other techniques. The substrate may be any convenient non-conducting material upon which a conductive pattern can be deposited.

Figure 1A:
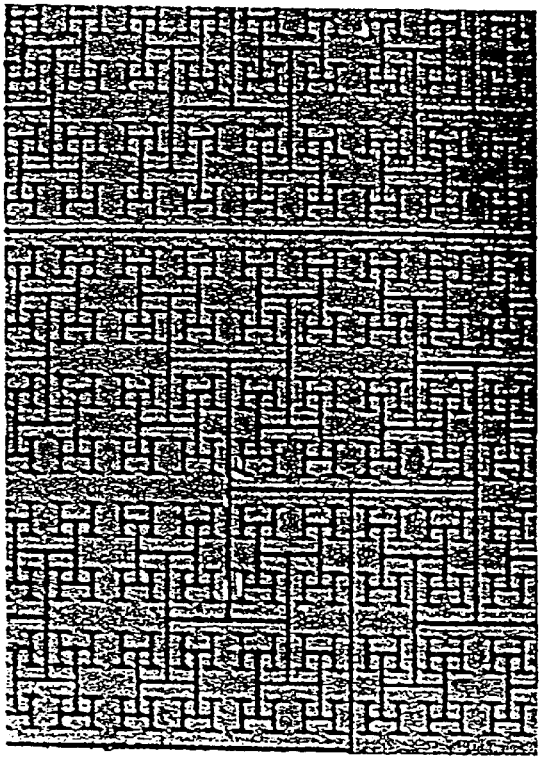
FIGS. 1A and 1B show the fractal pattern of a first embodiment of the invention, FIGS. 2(*a*) and (*b*) show the transmission and reflection of y-polarized incident radiation of a first embodiment of the invention.
Figure 1B:
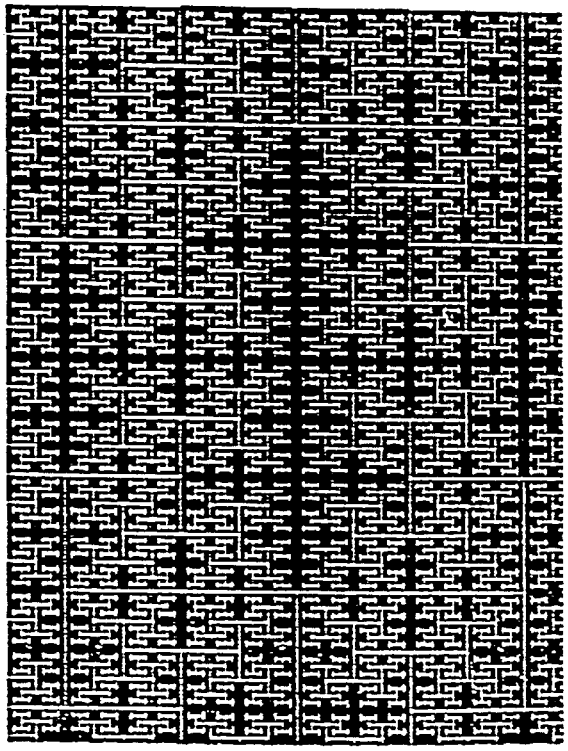

FIG. 1 shows a fractal pattern according to a first embodiment of the invention. In this embodiment the pattern is a space-filling curve comprising an H shape that is subject an affine transformation in the form of repeated scaling down by a given factor, and rotation through 90°. Two patterns are in fact shown in FIG. 1, one with a 10-level structure and one with a 12-level structure (the term "level" referring to the number of times that the fractal creating transformation is applied to the original element. As will be shown below, the number of levels of the pattern can be used to tune the band gap.

Figures 2A, 2B:
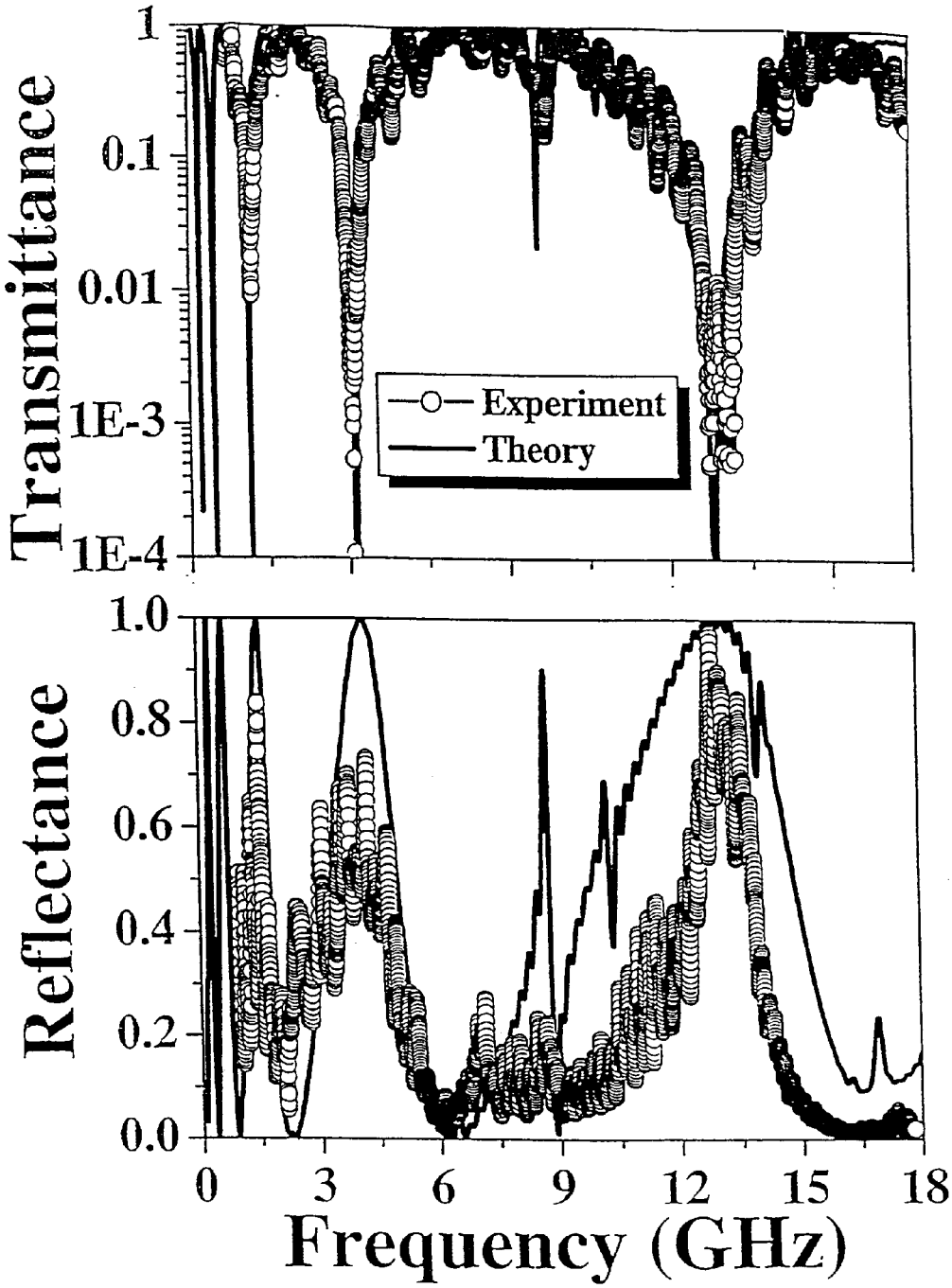

FIG. 2 shows (a) the transmission and (b) the reflection of a y-polarized electromagnetic wave incident normally on the fractal plane. In this embodiment the fractal pattern has 15 levels and the mother element is a horizontal H-shape of 14.5 cm height and breadth as follows:

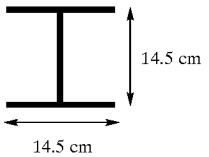

The total pattern is formed by scaling this element by a factor of 0.5 (so that at the next level the dimensions are 7.25 cm, the level following that is 3.625 cm and so on), and attaching to the four free ends as follows:

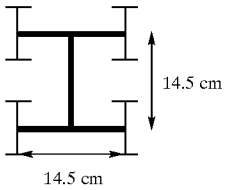

It will be seen from FIG. 2(*a*) that there are resonances at about 1.5, 4 and 13.5 GHz at which transmission is close to 0 and reflection is almost 100%. The size of the smallest H in the pattern determines the highest frequency gap and the lowest frequency gap is determined by the number of levels.

Once the size of the largest H is fixed, then the total size of the fractal pattern is also fixed. If it is desired to cover a larger surface area with the pattern, then this cannot be done simply by scaling up as that would alter the bandgap properties. Instead a fractal pattern with the desired properties can simply be tiled and replicated over the larger area.

It should also be noted that a plate with a fractal pattern functioning as a reflector may have dimensions smaller than the wavelength being reflected. This is an unusual and very useful property of embodiments of the present invention that it not found in conventional metal reflectors.

Figure 3:
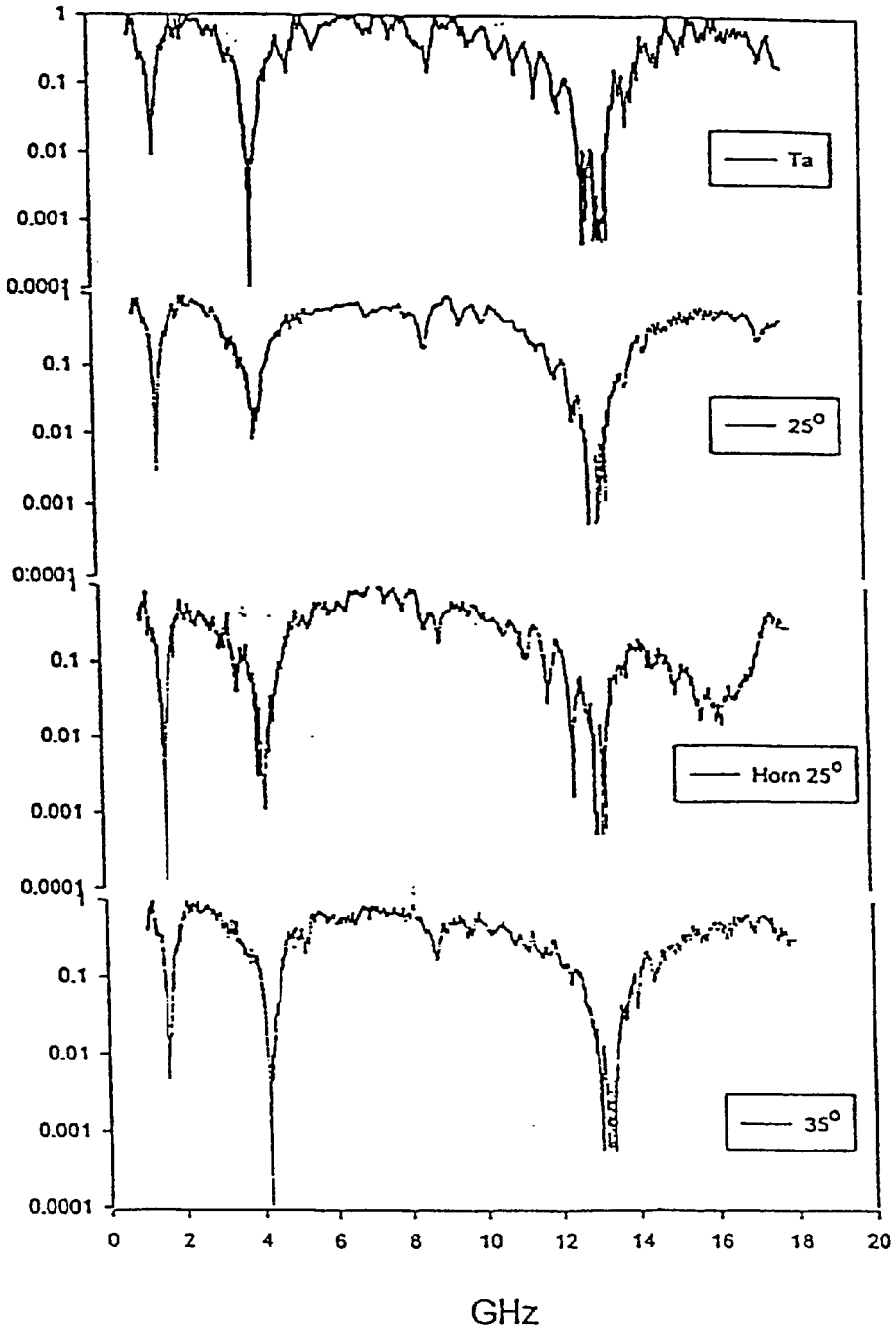
FIG. 3 shows the transmission at differing incident angles, FIGS. 4(*a*) and (*b*) show the transmission and reflection of x-polarized incident radiation of a first embodiment of the invention, FIG. 5(*a*) shows the transmission spectra of two fractal patterns of different levels, FIG. 5(*b*) shows the transmission spectra of fractal patterns with different mother element size and also embedded in dielectric.

FIG. 3 shows the result of varying the incident angle of the electromagnetic radiation to a plate bearing the fractal pattern of FIG. 2. It will be seen that the resonances stay at the same location regardless of the incident angle which is varied between transmission (Ta) at normal incidence (y-polarized radiation), at 25° and 35°. It should be noted here that in the plot marked "Horn 25°" that source of incident radiation is varied while the sample remains fixed, while the plot labelled "25°" corresponds to fixing the source and varying the sample position. It will be seen that no difference between these is observed.

The fact that the plate of the embodiment of FIGS. 2 and 3 can give nearly perfect reflection for certain frequencies at different incident angles differentiates the present invention from conventional technology. For example, a coated metal plate will reflect microwave radiation over a wide range of frequencies and at all incident angles, but it cannot be frequency selective. On the other hand a frequency selective reflector can be made by a structure formed of composite dielectric multilayer coatings, but this can only reflect specific frequencies at or near normal incidence. The combination of frequency selectivity at a range of incident angles provides the materials of the present invention with a significant advantage over the prior art. A further advantage of the present invention over conventional frequency-selective surfaces (which traditionally rely on periodic patterns) is its "sub-wavelength" property (by which is meant the ability of a structure with a dimension much smaller than a wavelength to be able to reflect that wavelength), and additionally the ability to select multiple frequencies for reflection.

Figures 4A, 4B:
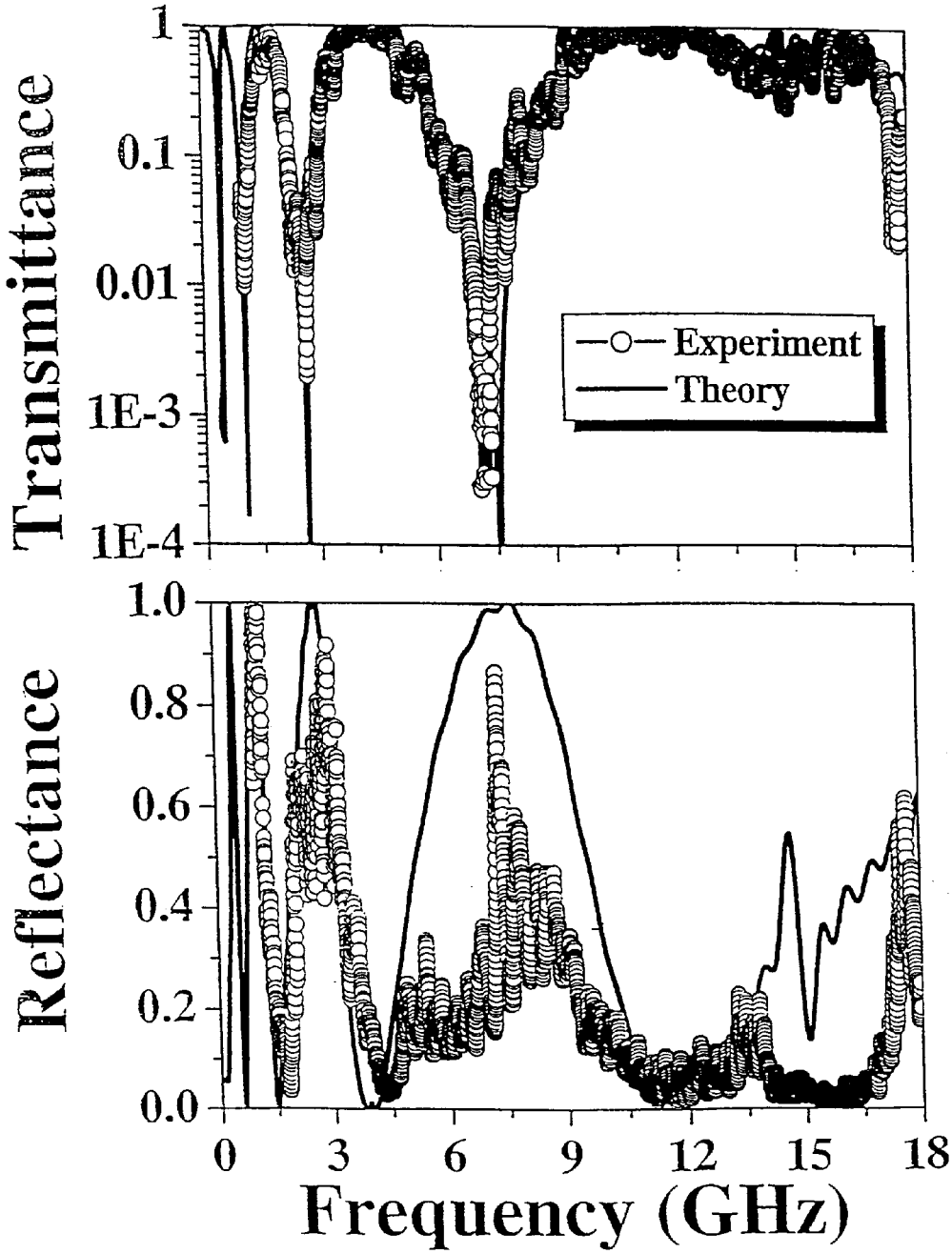

The transmission properties of the band gap material of this embodiment of the present invention are not rotationally symmetrical. In particular the material behaves as a polarizer because the gaps are located in different parts of the spectrum for the x and y polarizations. This can be seen by comparing FIG. 4, which shows the transmission and reflection of an incident x-polarized wave, with FIG. 2. It should be noted that an absolute band gap material that is rotationally symmetrical can be formed by superimposing two sheets of identical material with one rotated through 90° relative to the other.

The band gap properties of the material of the present invention can be tuned and modified in a number of ways. Firstly, for example, the precise location of the band gap can be varied by the number of levels forming the fractal pattern. This can be seen for example by considering FIG. 5(*a*) which compares the transmission pattern of two embodiments of the invention: one with 15 levels, the other with 10 levels. It will be seen that the resonances are at slightly lower frequencies for the 15 level embodiment than for the 10 level embodiment.

Other ways of tuning the band gap locations include varying the size of the "mother" element of the space filling curve (in this case the largest H). The larger the size of the mother element, the lower the resonant frequencies. This is illustrated with reference to FIG. 5(*b*) in which the open squares represent the results for a four-level H-shaped pattern with the first level having lines 16 mm long and 0.2 mm wide. The solid circles are for the same structure embedded within a 4 mm thick dielectric substrate with a dielectric constant $\in$=2.2. The open triangles are for a four-level H-shape pattern with the dimension of the first level increased to 20 mm. It can be seen from FIG. 5(*b*) that as the size of the mother element is increased, the wavelengths of the bandgaps increase and the frequencies decrease.

Figure 5A:
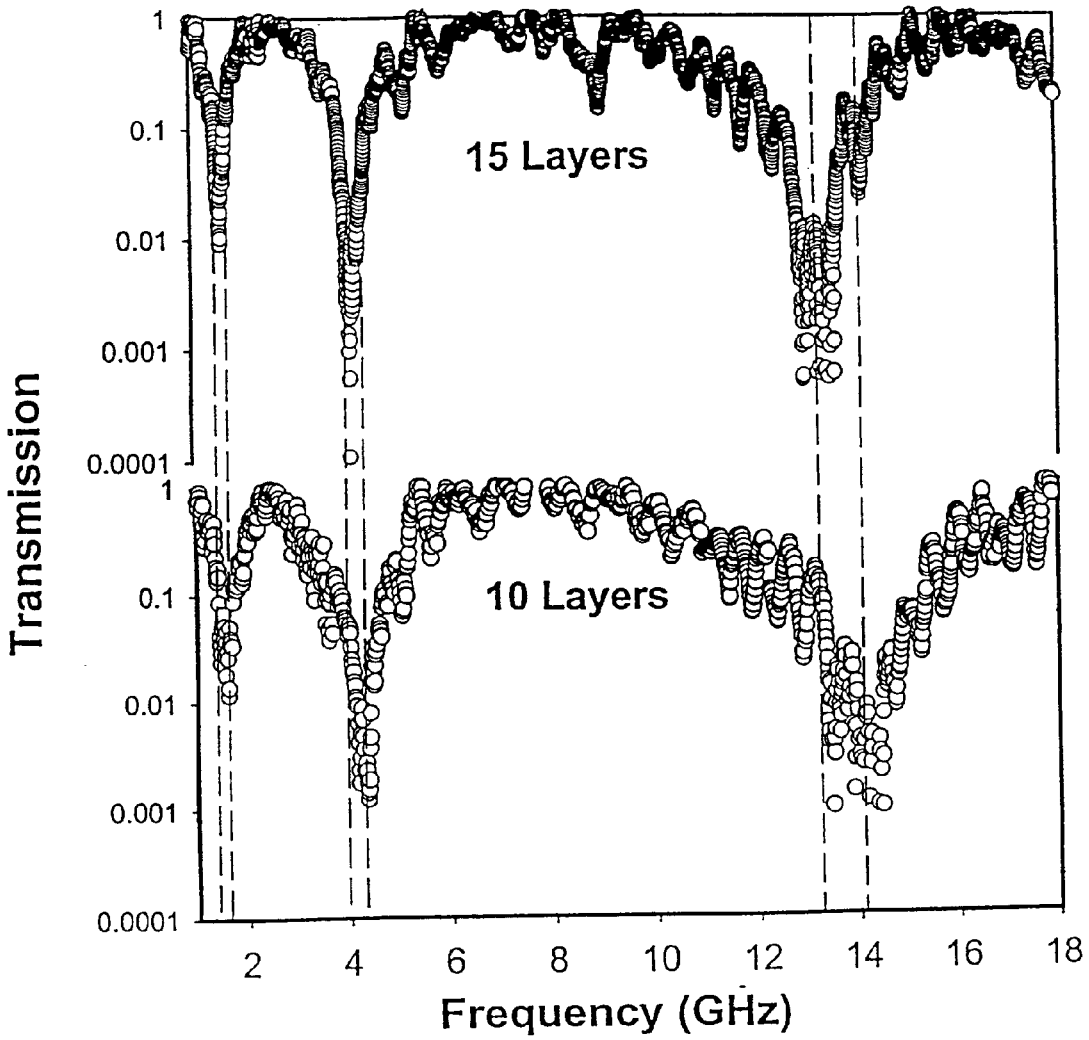
Figure 5B:
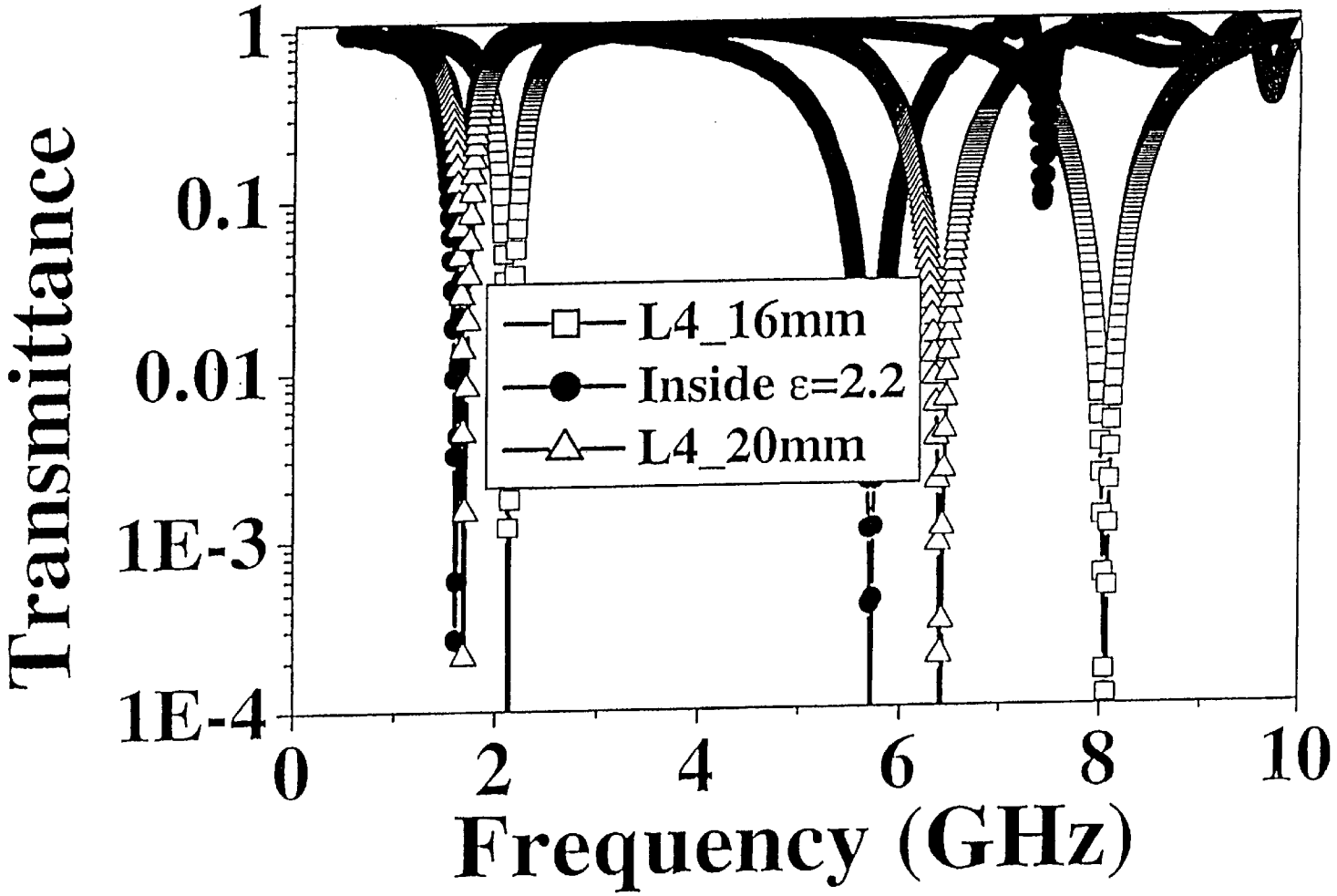

FIG. 5(*b*) also shows that the band gaps may be tuned by applying a dielectric surface coating. This has the effect of shifting the transmission gaps downwards. If a thick dielectric substance is coated on both sides of the fractal pattern, the band gaps would be shifted to a lower frequency by a factor of $\sqrt{\in}$. In reality with a substrate of finite thickness the scaling factor would be smaller than $\sqrt{\in}$ and could be calculated by numerical simulation.

Figure 6:
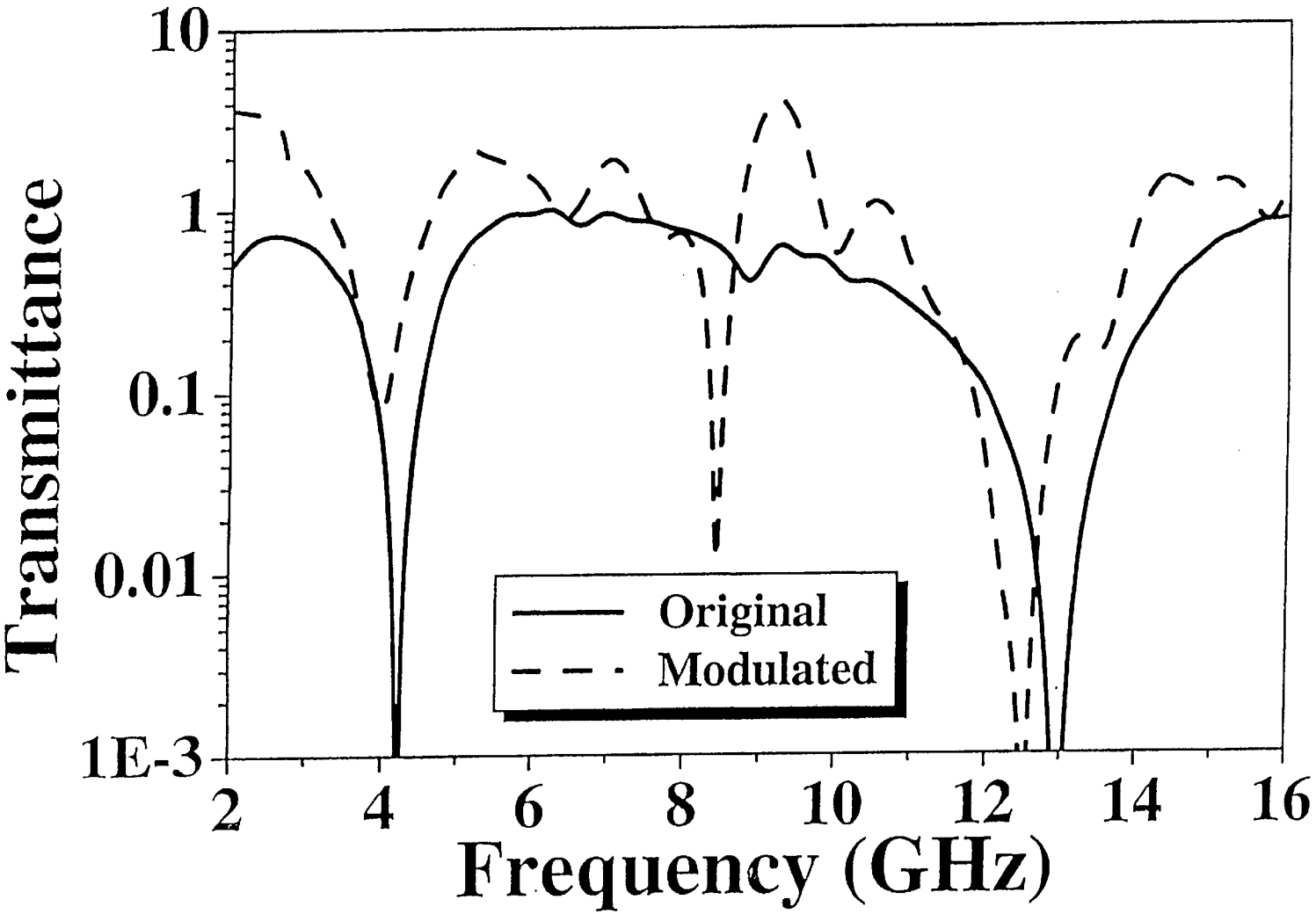
FIG. 6 shows the effect of applying a signal to the fractal pattern and thereby tuning its frequency-selective property, FIGS. 7(*a*)–(*c*) shows the effect on transmission of applying a signal to the fractal pattern in phase and out of phase with radiation being transmitted.

A significant advantage of the present invention is that the properties of the band gap material can be actively tuned. This is possible by applying a varying signal to the conductive fractal pattern itself. FIG. 6 shows the reflection and transmission of an embodiment of the invention formed of a seven level fractal structure in which the mother element is an H shape 9 mm long with line width and thickness being 0.1 mm. The fractal pattern is embedded in a 1 mm thick dielectric substrate with $\in$=5.3. The modulation source applied to the pattern is pulsed ac current fed into the middle of the longest line in the fractal pattern. In FIG. 6 the solid line shows the transmittance when the fractal plate is used as a passive component. The broken line shows the transmittance when a pulsed current is injected into the fractal, the interference of the induced surface current (induced by the incident radiation) and the injected current lead to a different radiation pattern in the far field. From an observation of FIG. 6 it can be seen that following the injection of current the transmission dips near 4 GHz and 13 GHz experience both a frequency shift and a change in amplitude. IN addition a new dip in transmission can be observed at about 8.5 GHz. It should be noted in particular that the spectra in the vicinity of the band gaps are substantially altered. In particular a band gap may be turned "on" and "off" by the application of a signal to the conductive fractal pattern of the band gap material.

Figures 7A, 7B, 7C:
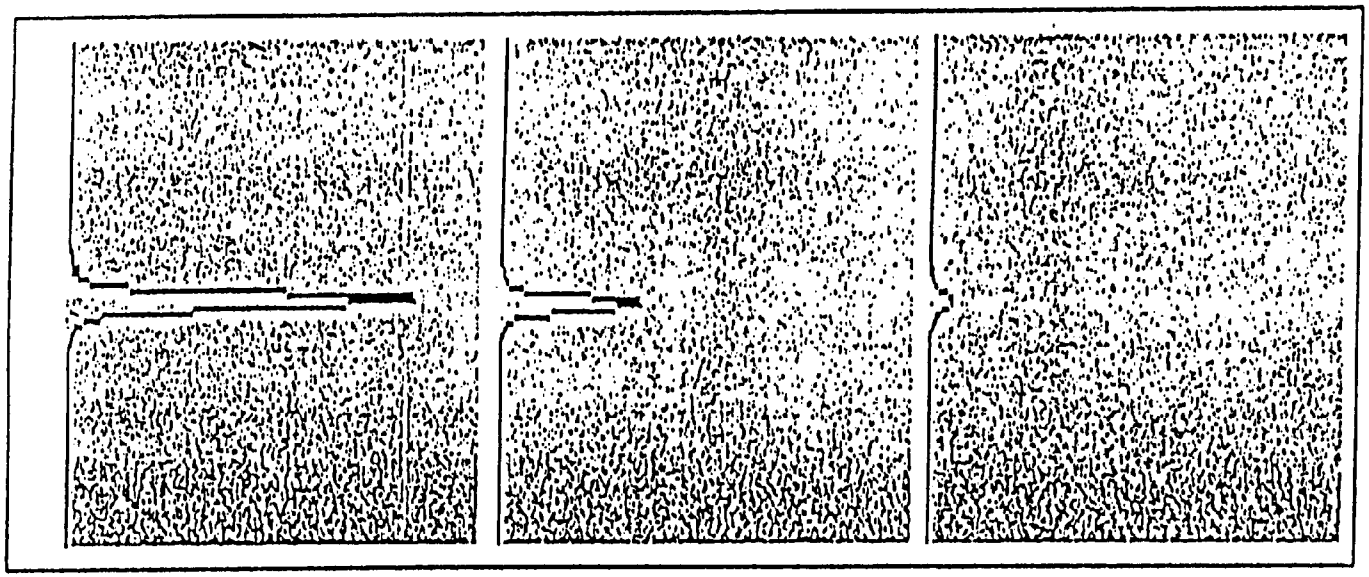

FIGS. 7(*a*)–(*c*) show the effect on the transmission of applying a signal directly to the conductive fractal pattern at the same time. In this figure, FIG. 7(*b*) shows the transmission of a 2 GHz electromagnetic wave through a band gap material according to the embodiment of FIG. 2. In FIG. 7(*a*) a 2 GHz signal that is out of phase with the electromagnetic wave is applied directly to the conductive fractal pattern and it will be seen that the transmission amplitude decreases. Conversely if a signal of the same frequency and in phase with the incident is applied, the transmission increases as shown in FIG. 7(*c*). FIGS. 7(*a*)–(*c*) show pictures directly captured from a display screen during experiments.

Figure 8:
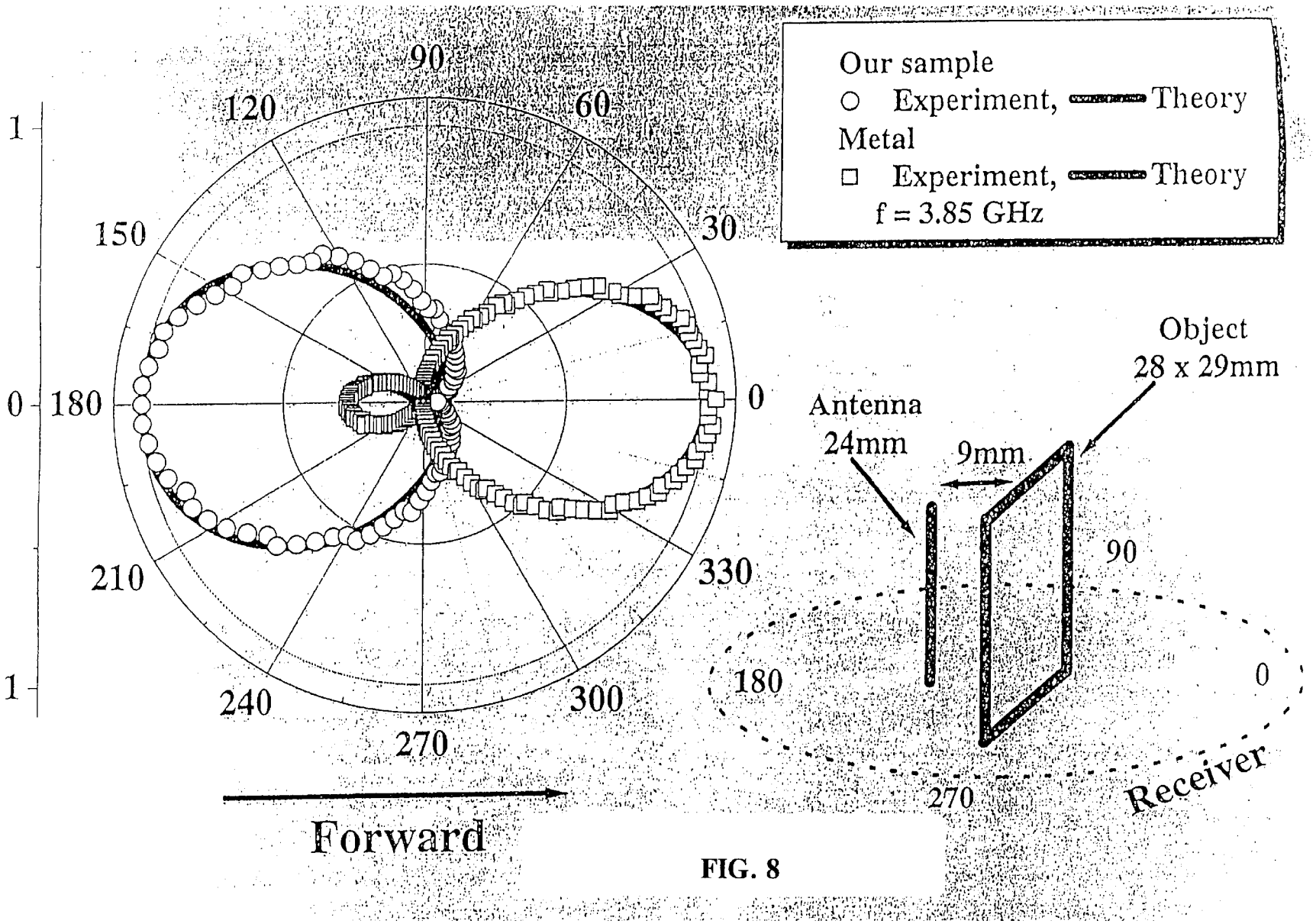
FIG. 8 illustrates the ability of an embodiment of the present invention to form a shield to electromagnetic radiation, FIGS. 9(*a*)–(*c*) illustrate the use of a sub-wavelength fractal plane according to an embodiment of the invention to improve the focus of a perpendicular monopole antenna, FIGS. 10(*a*)–(*c*) illustrate the use of a sub-wavelength fractal plane according to an embodiment of the invention to improve the focus of a perpendicular monopole antenna, and FIGS. 11(*a*) and (*b*) shows transmittance spectra for (a) a simple wire mesh and (b) a combination of a wire mesh and fractal plate in accordance with an embodiment of the invention.

FIG. 8 shows the basic set up and results of a simple experiment that shows the effectiveness of embodiments of the present invention in forming a shield. An 24 mm long antenna is placed 9 mm from a planar photonic band gap material according to an embodiment of the invention. The planar band gap material is approximately a square (28×29 mm) and has applied to it a fractal pattern so as to define a band gap at about 3.85 GHz, the frequency transmitted by the antenna. The antenna is positioned so as to lie parallel to the plane of the bandgap material. As can be seen from the results, the radiation is substantially completely reflected from the small piece of planar bandgap material and none is transmitted. This is in contrast to the results for a simply piece of metal of the same size, because metal cannot block electromagnetic radiation if the dimension of the metal plate is less than half the wavelength (which is 78 mm). This simple experiment shows that the present invention would, for example, have a particular application in shielding the user of a mobile phone from electromagnetic radiation from the phone antenna (which radiation is thought to be a possible health risk). In this embodiment the fractal structure is formed with six levels. The mother element is an H-shape with a length of 16 mm, line width 1 mm, line thickness 0.2 mm printed on a 2 mm thick dielectric substrate with $\in$=5.3. It is important to note here that the fractal materials of the present invention are superior to conventional photonic bandgap materials. Not only are the materials of the present invention potentially much thinner, but they can also be much smaller in lateral directions and indeed can be smaller than the wavelength of the radiation being reflected, that is to say their dimensions can be "sub-wavelength" in all directions. Since conventional photonic bandgap materials operate on Bragg reflection principles, the lateral dimensions must be at least a few times the wavelength before they can be effective. However, the fractal materials of the present invention are able in preferred embodiments to have all dimensions smaller than the wavelength of the radiation. FIG. 8 illustrates that while a metal plate of a size 28 mm×29 mm is too small to shield radiation with a 78 mm wavelength, a fractal plate of the same size can do so.

The property of the materials of preferred embodiments of the invention of substantially zero transmission and 100% reflectance at the bandgap frequency, can be used to substantially improve the efficiency and directionality of a radiating antenna.

Figure 9A:
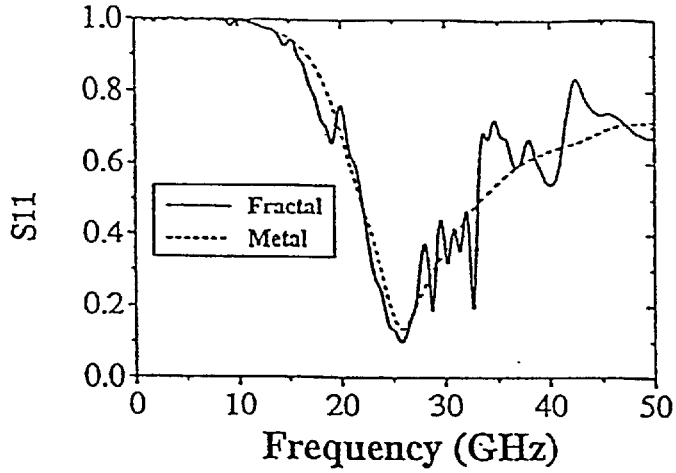
Figure 9B:
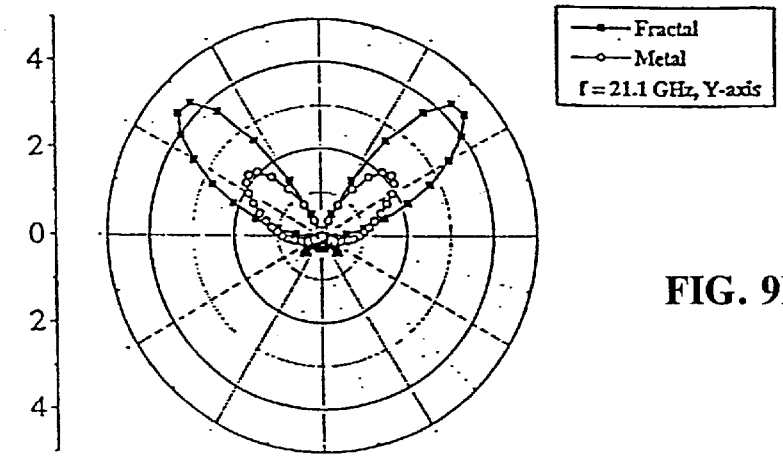
Figure 9C:
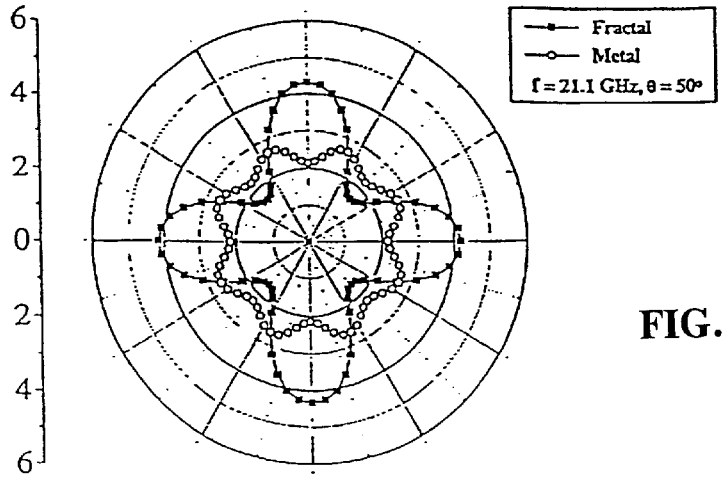

FIGS. 9(*a*)–(*b*) show FDTD (finite difference time domain) simulated radiation patterns when an antenna is placed above and perpendicular to either a planar bandgap material according to an embodiment of the invention and designed to reflect radiation at the frequency of the antenna (21.1 Ghz) (solid squares) or a piece of metal 30 mm by 30 mm (open circles). In this example the planar fractal bandgap material is formed of two plates spaced apart by 0.1 mm and each having a pattern with eight levels, first level length=16 mm, metal line width=0.2 mm, and thickness of metal lines=0.2 mm. The two metal plates are rotated by 90° relative to each other to give a complete band gap for all polarizations. Since the bandgap material reflects the electromagnetic radiation, the antenna can only radiate on the side opposite to the plane of the bandgap material and the radiation is more focussed than with a metal plate in place of the bandgap material.

FIG. 9(*a*) shows the radiation pattern in the θ angle. FIG. 9(*b*) shows the radiation in the ϕ angle and shows that the bandgap material creates greater anisotropy and thus again a more focussed radiation.

Figure 10A:
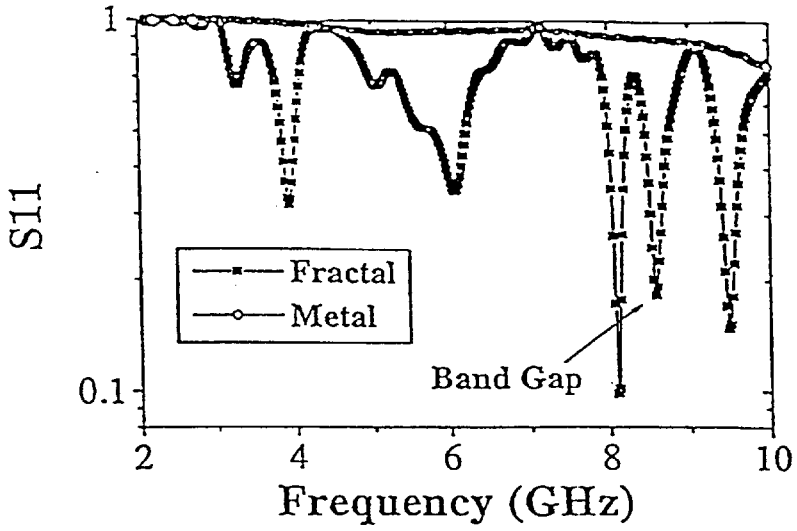
Figure 10B:
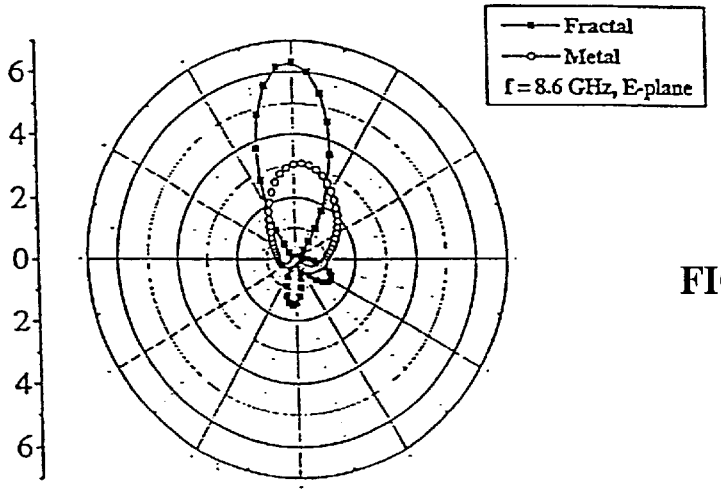
Figure 10C:
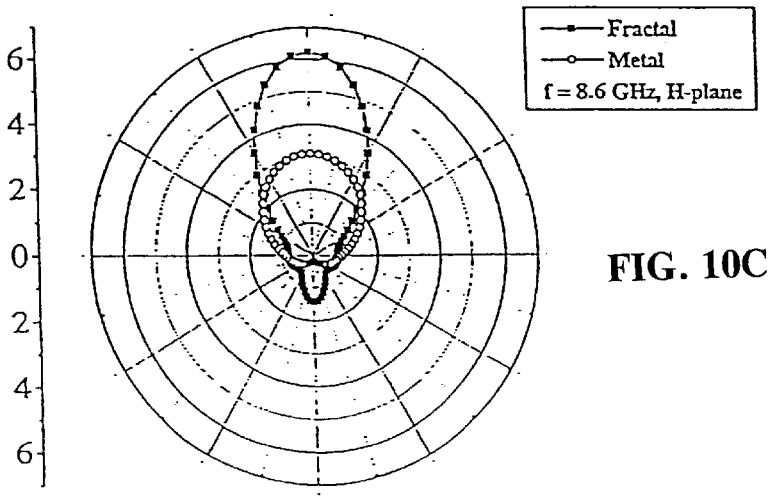

FIGS. 10(*a*)–(*c*) illustrate the effect of putting a planar bandgap material (with a six level pattern with the length of the first level being 16 mm, line width 0.2 mm, line thickness 0.2 mm and with a 2 mm thick silicon substrate with ∈=12) according to an embodiment of the invention beneath a monopole radiating antenna with the antenna parallel to the plane of the bandgap material. The antenna is 0.2 cm above the bandgap material and separated from it and supported by a dielectric material. The antenna radiates at 8.6 GHz (which corresponds to a wavelength of 34.9 mm). The fractal pattern on the bandgap material is chosen to prevent transmission at the radiating frequency of the antenna. FIGS. 10(*a*)–(*c*) also show the corresponding results for a metal plate 28 mm by 28 mm.

FIGS. 10(*a*) and (*b*) show finite difference time domain (FDTD) simulations of the radiation pattern where a bandgap material in accordance with the invention is placed beneath the antenna (solid squares) and where a plate of metal of the same size is placed beneath the antenna (open circles). FIG. 10(*b*) shows the radiation in the E-plane, and FIG. 10(*c*) the radiation in the H-plane. It should be noted that the bandgap material of the present invention reflects the radiation from the antenna with better directionality than does the metal plate. In addition, a metal plate located so close to the antenna has the effect of shorting the antenna making the antenna efficiency very low. This can be seen from FIG. 10(*a*) where it can be seen that S11 for the metal plate (which provides a measure of the reflectance back to the source) is close to 100%, whereas for the bandgap material of the embodiment of the invention it is much lower, meaning that the antenna is radiating more efficiently. This emphasizes that even though a simple piece of metal can reflect the radiation of an antenna at high frequencies (because the dimensions of the plate exceed half the wavelength), the radiation efficiency of the antenna will be compromised if the metal plate is at the near field position, whereas the materials of the present invention can be used to reflect the radiation without seriously degrading the antenna efficiency.

Figures 11A, 11B:
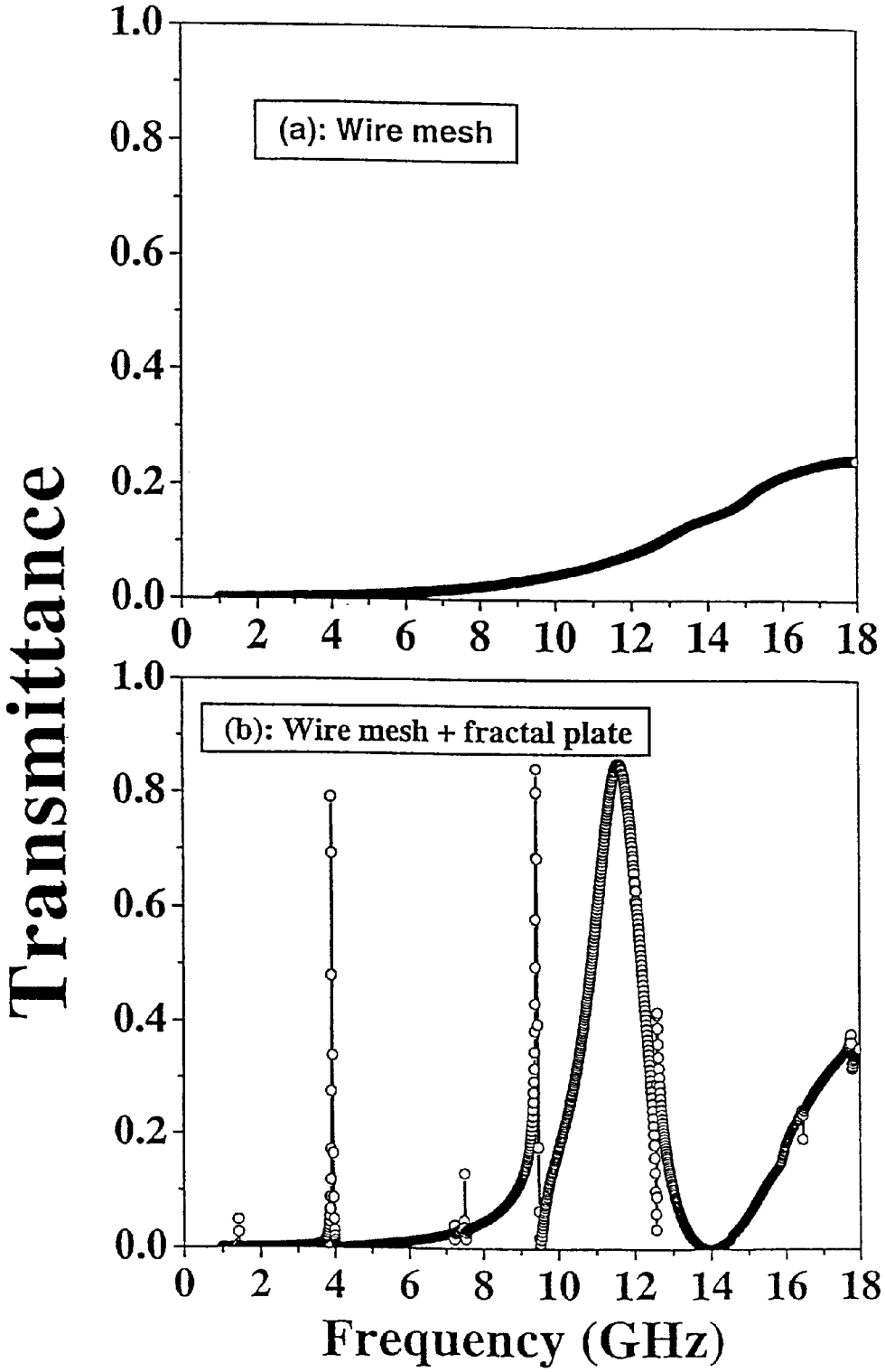
Figure 12:
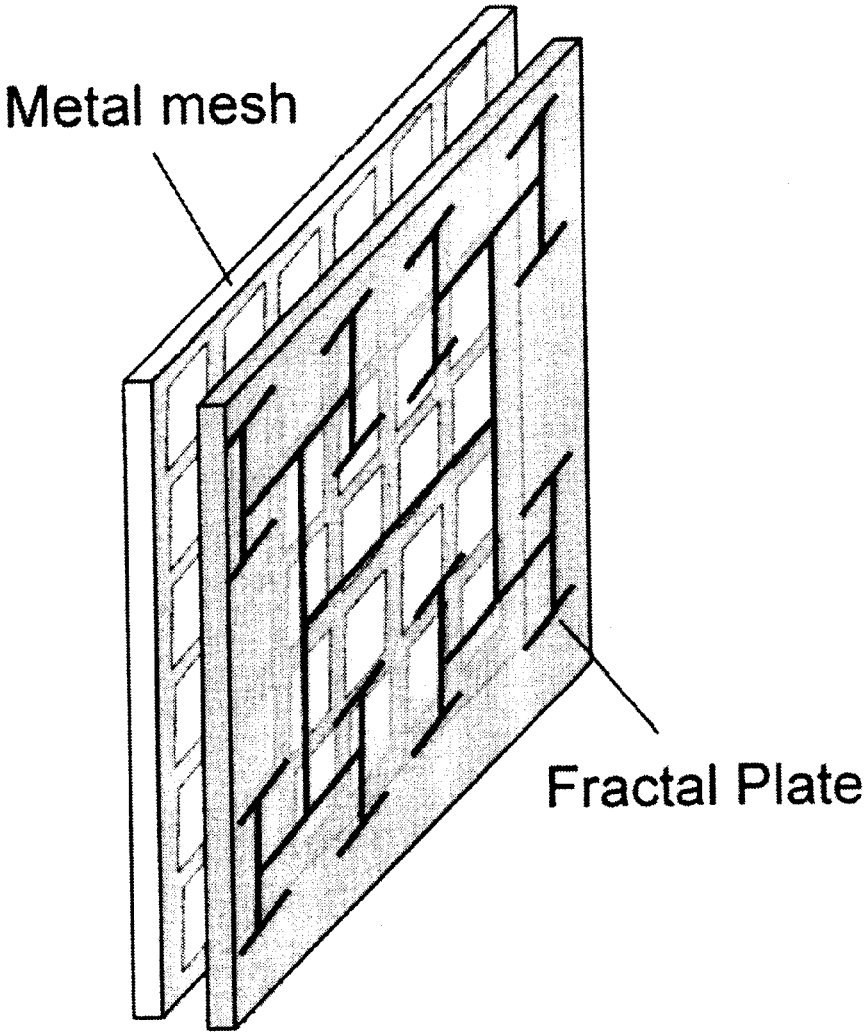
FIG. 12 illustrates a fractal plate in combination with a wire mesh.

FIGS. 11(*a*) and (*b*) illustrate another useful property of the materials of the present invention. It is well-known that a metallic wire mesh will serve as a high-pass filter and will reflect electromagnetic radiation at low frequencies while allowing high frequencies to pass through. FIG. 11(*a*) shows the typical transmittance of a wire mesh formed of wires of 0.1 mm thickness and a lattice parameter (square mesh) of 2 mm. However, if a fractal plate is placed at a close distance to the mesh, as illustrated in FIG. 12, then the transmittance properties are changed and sharp narrow pass bands are formed. FIG. 11(*b*) shows this phenomenon when a 7 level fractal plate formed on a 1.6 mm dielectric substrate (with dielectric constant 5.3) and with mother element being an H shape with a length of 8 mm and a line width of 0.1 mm is provided 0.1 mm behind the mesh. It should be noted that sharp transmission peaks are observed at 4 and 9.5 GHz. Without the fractal plate, the wire mesh on its own is nearly totally reflecting at 4 BHz, whereas with the fractal plate there is almost 80% transmission.

The physical basis for this effect is that if the fractal plate and the mesh are closely spaced (so that the wavelength of interest is at least a few times larger than the spacing) the fractal plate and the mesh will be seen by the radiation as a composite system with a single effective dielectric constant. Individually both components (ie the mesh and the fractal plates) have dielectric constants that vary with frequency. The effective dielectric constant of the mesh is negative, while that of the fractal plate varies from positive to negative as it passes through a resonance. It is theorised that there will be certain frequencies where these two effective dielectric constants combine to give a resultant constant that is one or nearly one and the composite system becomes suddenly transparent to the incident radiation.

What is claimed is:

1. A planar bandgap material comprising a non-conducting planar substrate with a conductive fractal pattern formed thereon which is tuned to define at least one predetermined transmission bandgap for the material.

2. A bandgap material as claimed in claim 1 wherein the fractal pattern is formed with between 2 and 15 levels.

3. A bandgap material as claimed in claim 1 wherein the fractal pattern is formed by subjecting a mother element to a repeated affine transformation.

4. A bandgap material as claimed in claim 3 wherein said mother element is an H-shape and said transformation comprises scaling.

5. A bandgap material as claimed in claim 1 wherein the fractal pattern is embedded within a dielectric material.

6. A bandgap material as claimed in claim 1 further comprising means for injecting a current into the fractal pattern so as to alter the bandgap properties of said material.

7. A bandgap material as claimed in claim 1 wherein the low-frequency limit of the bandgap(s) possessed by the material is determined by the number of levels of said fractal pattern.

8. A planar bandgap material comprising a non-conducting planar substrate with a conductive fractal pattern formed thereon which determines at least one bandgap at a wavelength that is larger than all the dimensions of said substrate.

9. An electromagnetic radiation shield comprising a substrate having formed thereon a conductive fractal pattern that is tuned to define at least one predetermined reflection band for said shield.

10. A method of forming a bandgap material comprising the step of forming a conductive fractal pattern on a planar substrate with a mother element whose dimensions and number of levels are selected to define at least one predetermined bandgap for said material.

11. A method of forming a bandgap material as claimed in claim 10 further comprising embedding said fractal pattern in a dielectric substrate.

12. A method of forming a bandgap material as claimed in claim 10 further comprising providing means for injecting a current into said pattern to thereby alter the bandgap properties of said material.

13. A narrow-band electromagnetic filter comprising a wire mesh material adjacent to a plate having a conducting fractal pattern formed thereon which defines a transmission bandgap for said plate.

* * * * *